United States Patent [19]

Korsgaard

[11] 4,075,726

[45] Feb. 28, 1978

[54] METHOD AND APPARATUS FOR BINDING A BOOK

[76] Inventor: Jens Korsgaard, 8650 Boulevard East, North Bergen, N.J. 07047

[21] Appl. No.: 649,541

[22] Filed: Jan. 20, 1976

[51] Int. Cl.[2] ..... B42C 19/00; B42C 11/00

[52] U.S. Cl. ..... 11/1 R; 11/3; 281/21 R; 222/302; 222/379

[58] Field of Search ..... 11/3, 1 R; 281/21 R; 222/302–304, 312, 451, 452, 309, 354, 359, 379, 381

[56] References Cited

U.S. PATENT DOCUMENTS

| | | | |
|---|---|---|---|
| 1,696,376 | 12/1928 | Ayars | 222/302 |
| 3,717,366 | 2/1973 | Decker | 11/1 R X |
| 3,788,921 | 1/1974 | Polit et al. | 281/21 R X |

*Primary Examiner*—Stephen C. Pellegrino
*Attorney, Agent, or Firm*—Burgess, Ryan and Wayne

[57] ABSTRACT

In a book binding apparatus, a book to be bound is clamped between a pair of plates, the distance between the clamps controlling the distance between a pair of groove bars engaging a cover to be bound to the book. A backup roll is positioned to engage the cover on the side opposite the groove bars, and to be movable along the cover to form grooves therein. A glue assembly is movable with the backup roll and includes a glue tube which is moved across the cover transversely of the direction of movement of the backup roll. The extent of transverse movement of the glue tube is controlled in response to the thickness of the book. A positive displacement pump supplies glue to the glue tube.

9 Claims, 11 Drawing Figures

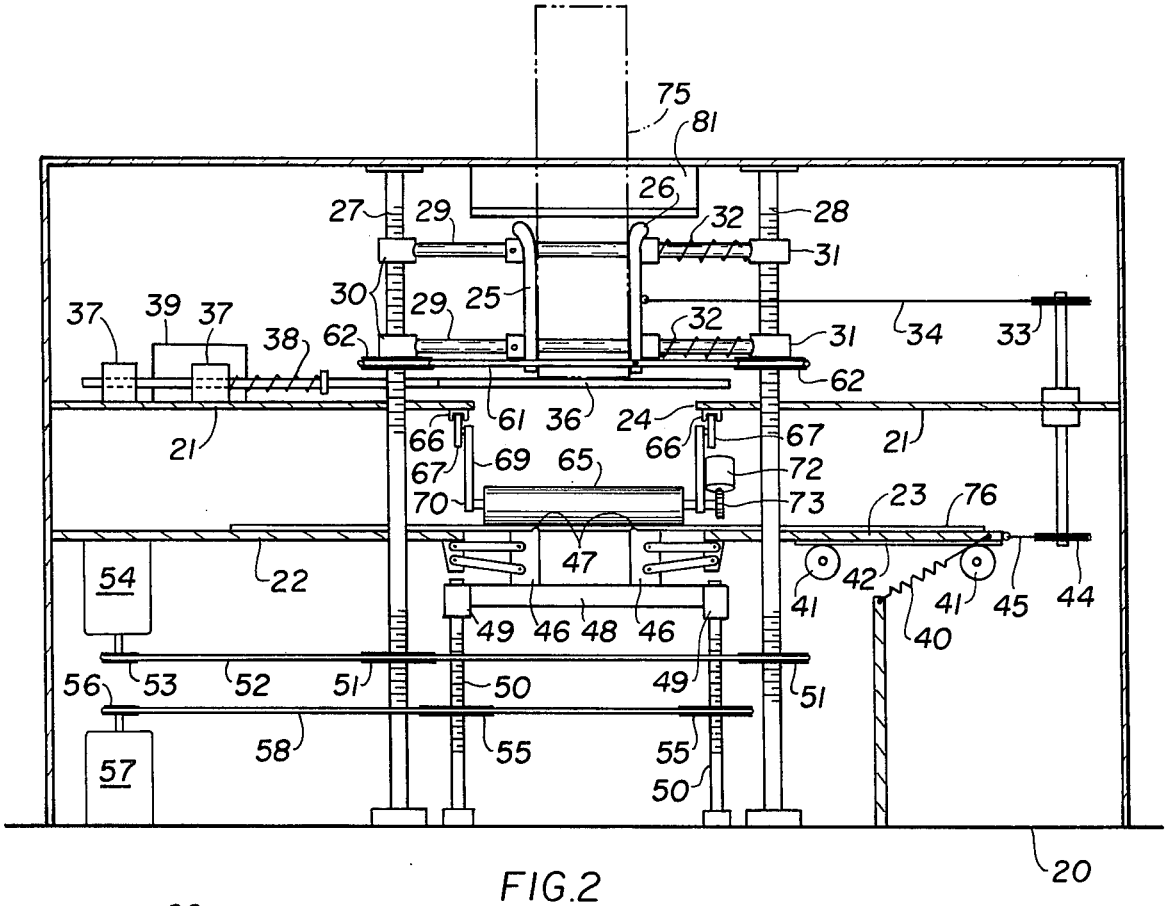
FIG.2
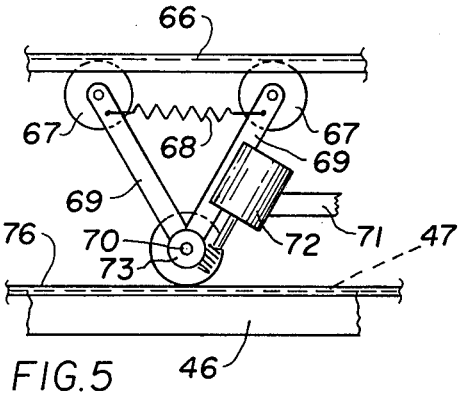
FIG.5
FIG.6
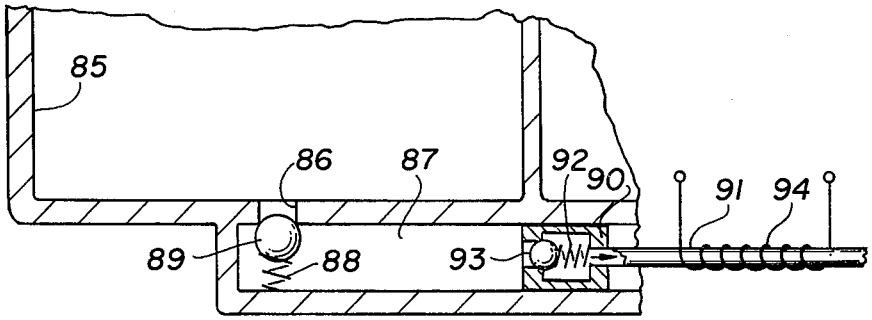

METHOD AND APPARATUS FOR BINDING A BOOK

This invention relates to a method and apparatus for binding a cover to a book, for example for adhesively affixing a cover of paper or the like to the back of a book, and is more particularly directed to a method and apparatus of this type wherein the cover is formed with parallel grooves to enable it to be bent around the book, and a layer of glue is applied to the cover to enable its affixing to the book.

In the past many forms of apparatus have been provided for the applying of covers to books. In general, however, such book binding equipment is adaptable only for large scale book binding operations, and it is not economically feasible to provide such equipment in establishments which are not primarily concerned with the printing and binding of books. For example, in some establishments it is necessary occasionally to produce books in limited quantities, say from one to 100 books, as a by-product of the normal business of the establishment. Since book binding equipment would be only occasionally used in such establishments, it would be too expensive for the establishment to have book binding equipment of the above type on its premises.

The invention is therefore directed to the provision of a method and apparatus for binding books, which is inexpensive to fabricate and is particularly adaptable to the binding of books on a limited scale.

Briefly stated, in accordance with the invention, a book binding apparatus comprises clamping means for holding a book to be bound, the clamping means providing a measure of the thickness of the book. A cover to be bound to the book is inserted in a grooving apparatus, including a pair of groove bars spaced apart in response to the clamping means. A backup roll cooperates with the groove bars to form grooves in the cover to facilitate the bending of the cover around the book.

A glue assembly is movable with the backup roll for applying glue to the cover, and includes a glue tube which reciprocably moves across the cover to deposit a band of glue on the cover of a width corresponding to the thickness of the book. Means are provided for controlling the width of the band in response to the clamping means. A positive displacemennt pump is provided for directing glue to the glue tube.

In order that the invention will be more clearly understood, it will now be disclosed in greater detail with reference to the accompanying drawings, wherein:

FIG. 2 is a transverse cross sectional view of the apparatus of FIG. 1;

FIG. 5 is a simplified side view of the grooving apparatus of the book binding apparatus of FIG. 1;

FIG. 6 is a cross sectional view of one embodiment of a positive displacement pump for use in the apparatus of FIG. 1;

DETAILED DESCRIPTION OF THE INVENTION

Figure 1:
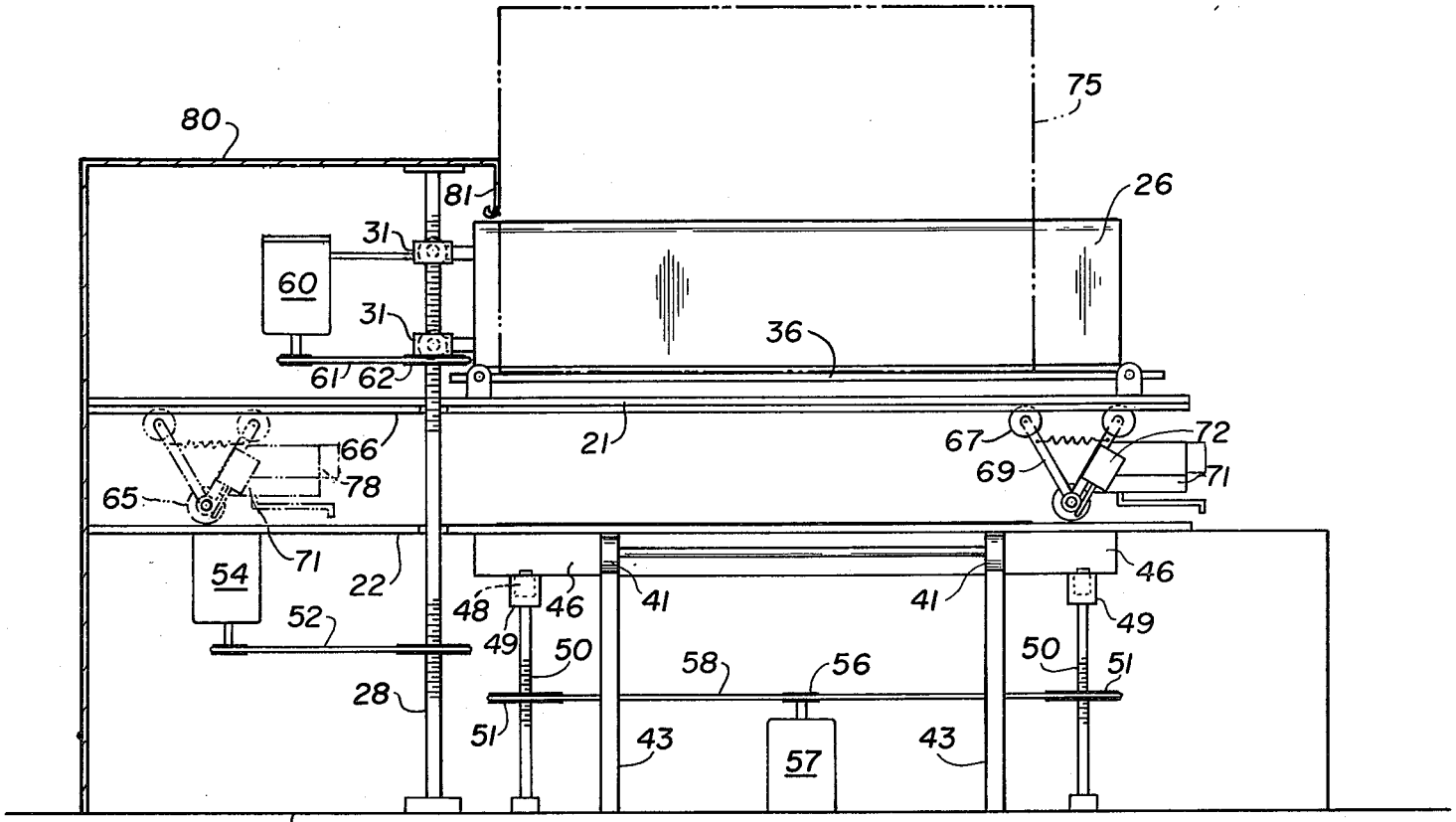
FIG. 1 is a longitudinal cross sectional view of a book binding apparatus in accordance with the invention.
Figure 3:
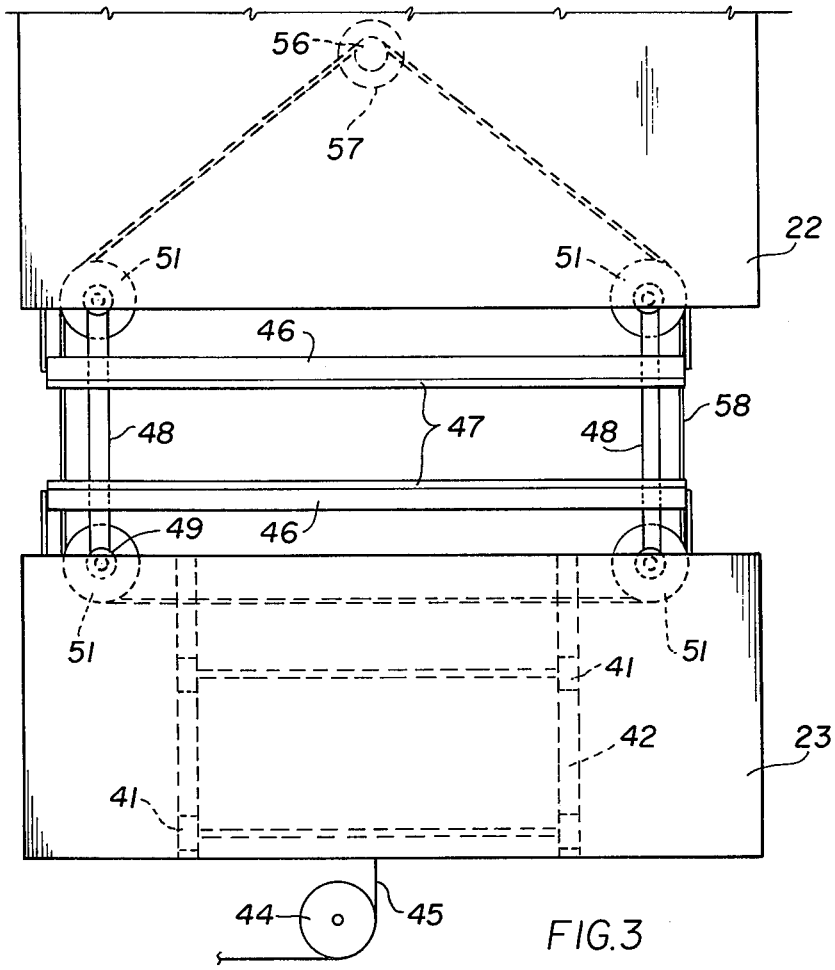
FIG. 3 is a top view of the cover mounting and grooving apparatus of the book binding apparatus of FIG. 1.

Referring now to the drawings, and more in particular to FIGS. 1–4, therein is illustrated a book binding apparatus in accordance with the invention. A housing illustrated generally by the numeral 20 has affixed therein a horizontal upper deck 21, and a fixed horizontal lower deck 22. A horizontally movable deck 23 is positioned in the plane of the deck 22.

The deck 21 has a central slot 24, and a pair of book holding plates 25 and 26 are positioned in spaced apart vertical planes above the slot 24. The plates 25, 26 are held for vertical movement by means of vertical threaded rods 27, 28 respectively. These rods are suitably journalled in the housing. The plate 25 is held in a horizontal position, for example by means of horizontal support rods 29 for holding the plate 25 to nuts 30 on the threaded rod 27. The plate 26 is horizontally movable on the rods 29, which are also affixed to the nuts 31 on the threaded rod 28. Suitable springs 32 are provided on the rods 29 to urge the plate 26 towards the plate 25. A pulley 33 is mounted to the plate 21, and a cable 34 extends around this pulley from the plate 26, the cable 34 extending to a suitable handle 35 on the exterior of the housing to enable an operator to pull the plate 26 away from the plate 25, against the force of the springs 32.

Immediately below the plate 25, 26 is a retractable horizontal plate 36. This plate may be mounted above the plate 21, for example, by means of rods 37 extending from the plate 36 and mounted in bushings 37 affixed to the plate 21. Springs 38 urge the retractable plate 36 to a position under the plates 25, 26. A solenoid 39, which may also be mounted on the plate 21, is connected to the plate 36, to enable withdrawing of the plate 36 from beneath the plates 25, 26.

The separation between the fixed lower deck 22 and the movable deck 23 is aligned with and beneath the slot 24 of the upper deck, and the movable deck 23 is resiliently urged toward the fixed deck 22, for example, by means of a spring 40. The movable deck 23 may, for example, be mounted on rollers 41 running in slots 42 in the bottom of the deck 23, the rollers 41 being suitably supported from the chassis, for example, by supports 43. The movable deck 23 is movable with the plate 26. For this purpose, a pulley 44 may be mounted beneath the deck 21, with a cable 45 extending from the deck 23 around the pulley 44, and thence to the handle 35.

A pair of grooves 46 are mounted with respect to the facing edges of the decks 22 and 23. These bars have ridges 47 in their upper surfaces, and the bars extend lengthwise of the slot 24. The groove bars 46 are supported from beneath by transversely extending bar supports 48 at each end of the groove bars. The ends of the bar supports 48 are provided with threaded nuts 49, which receive vertically extending threaded rods 50.

The threaded rods 27, 28 are provided with pulleys 51 driven by means of a cable 52 extending around a pulley 53 on a fixedly mounted motor 54, in order to vertically move the plates 25, 26. Similarly, the threaded rods 50 are provided with pulleys 55 driven from the pulley 56 of a fixedly mounted motor 47, by means of a suitable cable 58, in order to vertically move the bar supports 48.

The ridges 47 of the groove bars 46 extend slightly above the upper surface of the decks 22, 23 when the bar supports 48 are in their uppermost position. When the bar supports 48 are lowered, the groove bars 46 may fall free of the space between the decks 22, 23.

Figure 4:
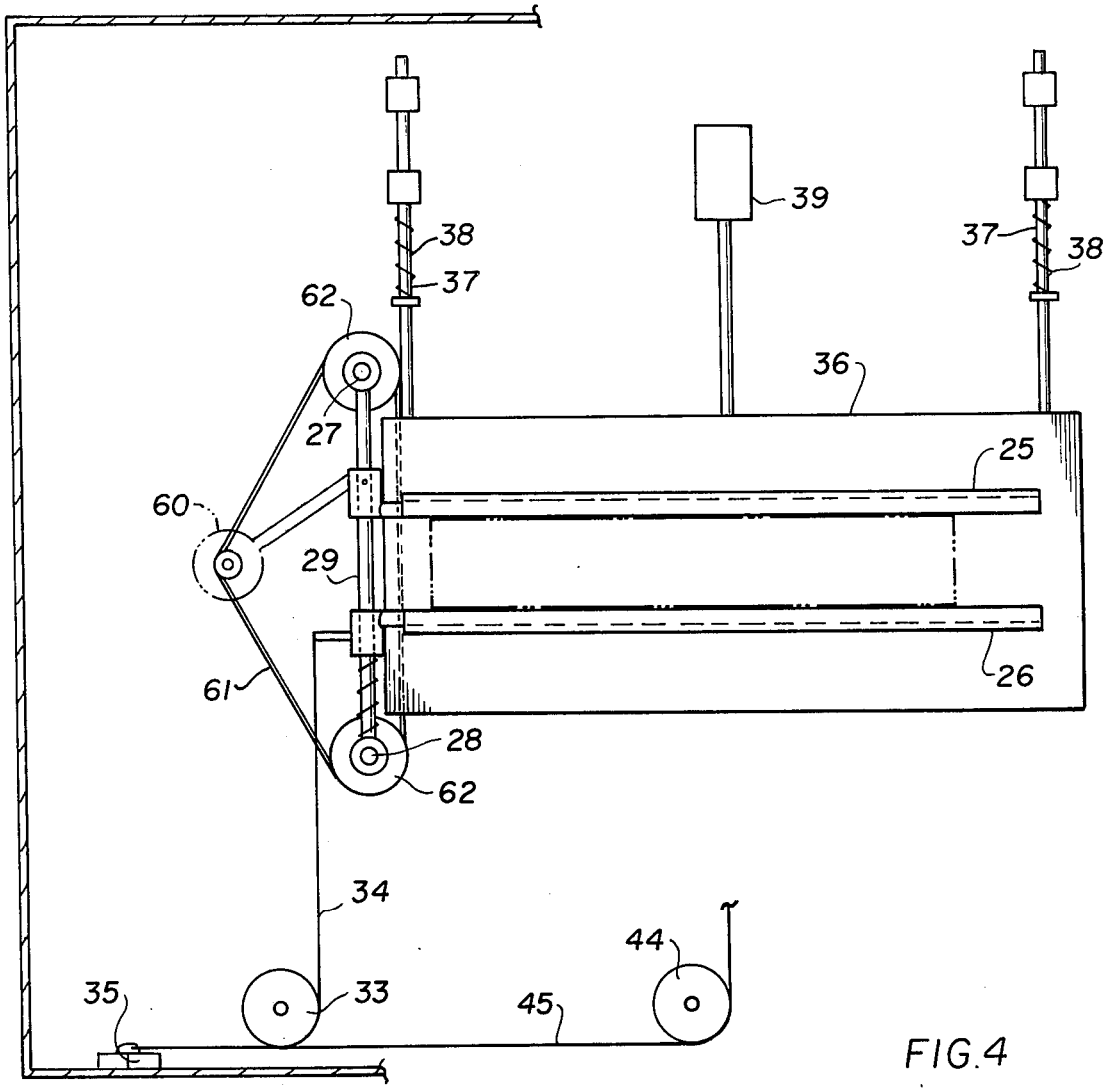
FIG. 4 is a top view of the clamping and retractable plate assembly of the apparatus of FIG. 1.

As shown in FIG. 4, a further motor 60 may be mounted in the assembly for driving a cable 61 extending around pulleys 62 rotatably mounted on the lower nuts 30, 31 at one end of the apparatus, the cable 61 being affixed to the plate 26 to enable automatic separation of the plates 25, 26.

A backup roller 65 is mounted between the decks 21 and 22, 23. As illustrated in FIGS. 2 and 5, this backup roller extends transversely of the slot 24, for movement in the longitudinal direction of the slot. For this purpose, channels 66 may be provided on the underside of the deck 21 at each longitudinal edge of the slot 24. A pair of rollers 67 is provided at each end of the roll 65, the pairs of rollers 67 being biased together by a spring 68. Arms 69 extend downwardly from each roller 67, the arms 69 being joined together to form bearings 70 for the ends of the roll 65.

As illustrated in FIGS. 1 and 5, a gluing assembly 71 is mounted to the support frame of the roll 65. This assembly will be discussed in greater detail in the following paragraphs.

A motor 72 is mounted to one of the arms 69, for rotating the roll 65, for example by means of a gear 73.

In the operation of the apparatus so far described, a book 75 to be bound is first inserted in the apparatus. For this purpose, the operator may operate the handle 35 to draw the plate 26 away from the plate 25, with the book 75 then being inserted between the plates 25, 26 until the edge thereof to be bound rests on the retractable plate 36. The handle 35 is then released, to allow the book to be firmly held between the plates 25, 26. At this time it will be noted that the deck 23 was also moved with the plate 26, and hence when the handle is released the edge of the deck 23 is separated from the edge of the deck 22 by a space dependent upon the thickness of the book. As a consequence, the ridges 47 of the groove bars 46 are spaced apart a distance corresponding to, or slightly greater than, the thickness of the book. A cover 76 to be affixed to the book is inserted on top of the decks 22, 23, in position beneath the book 75. Operation of the motor 72 then may drive the roll 65 across the top of the cover 76. Since the ridges 47 extend slightly above the top of the lower deck, and since the roll 65 is resiliently urged downwardly by springs 68, grooves will consequently be formed in the cover 76.

At the same time that the cover is being grooved by the above technique, an adhesivee is applied thereto, as will be discussed in greater detail in the following paragraphs. Prior to the next step of the operation, the retractable plate 36 is withdrawn, for example by means of solenoid 39. The bar supports 48 are lowered by means of the operation of the motor 57, and the book is lowered by rotation of the threaded rods 27, 28 by the motor 54. The book is lowered until it reaches and is forced into the cover 76, so that the cover is firmly adhesively affixed to the book. Then, the book is released, for example by operation of the motor 60 to separate the plates 25, 26. The book with the cover 76 affixed thereto may then be forced from the apparatus by backward movement of the roll 65. For this purpose, as illustrated in dashed lines in FIG. 1, the assembly 71 may be provided with a push rod or plate 78 positioned to engage the edge of the book and force it from the apparatus as the roll 65 is moved toward the right in this figure.

It should be noted that the housing 20 may have an upper horizontal plate 80 with a slot for receiving the book to be bound, the plate 80 having an edge 81 defining the end of this slot so that the book may be properly positioned for binding by engagement with the edge 81, as shown in FIGS. 1 and 2.

In accordance with the invention, a positive displacement pump is provided for applying a glue or adhesive to the cover. For example, as illustrated in FIG. 6, a glue reservoir 85 adapted to be mounted to the glue assembly structure 71, is provided with a bottom aperture 86, the aperture leading to a horizontal cylinder 87. The aperture is biased to be closed by a spring 88 urging a ball 89 upwardly from the cylinder 87 to seat at the edges of the aperture 86.

A piston 90 reciprocable in the cylinder 87 is driven by a tube 91, and a spring biased ball valve 92 is provided in the end of the piston, closing an aperture 93 leading from the cylinder to the tube 91. As a consequence, when the tube 91 is withdrawn from the cylinder, glue or adhesive in the reservoir 85 is withdrawn into the cylinder 87 by way of the aperture 86. Similarly, when the piston is moved into the cylinder, the aperture 86 is closed, and glue or adhesive in the cylinder is forced by way of the aperture 93 through the tube 91. The reservoir 85 may have suitable heating means (not shown) for heating glue therein, and a heating coil 94 may be provided on the glue tube 91.

Figure 7:
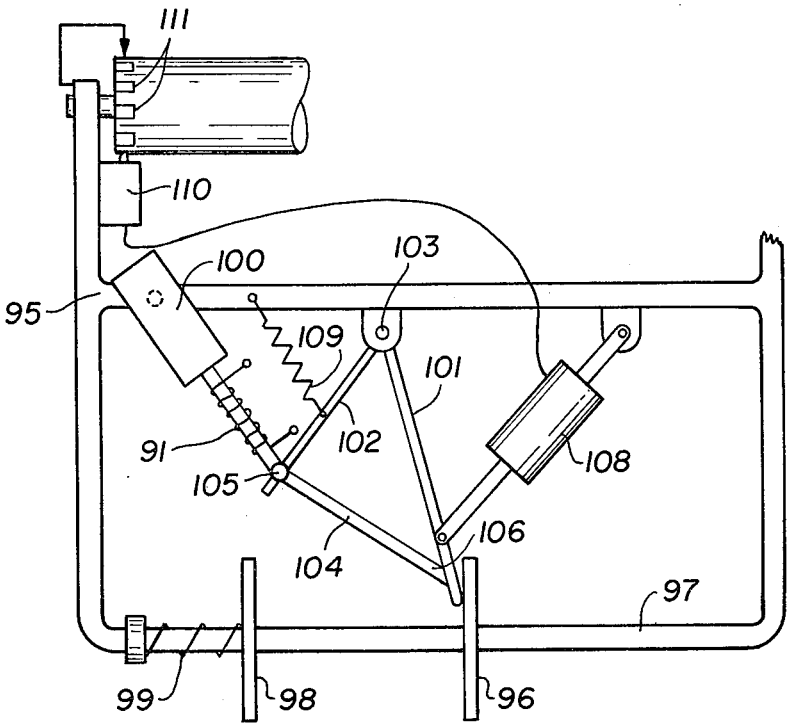
FIG. 7 is a simplified top view of a glue applying apparatus, including the pump of FIG. 6, which may be employed in the apparatus of FIG. 1.

In accordance with the invention, the adhesive is applied to the cover only in the region to be bound to the book. The glue assembly is moved with the grooving roll 65, and during this movement of the roll 65, the glue tube for applying adhesive to the cover must be moved back and forth across the area of the cover to be glued to the book. For this purpose, as illustrated in FIG. 7, the glue assembly comprises a carriage 95 mounted to the bearings of the roll 65. A fixed stop 96 is fixedly mounted to a transverse arm 97 of the carriage 95, and a movable stop 98 is movably mounted on the arm 97 and resiliently urged toward the stop 96 by means of a spring 99. The movable stop 98 is positioned to engage either the side of the book 75 or the plate 26, to space the plates 96 and 98 apart a distance corresponding to the thickness of the book. The movable stop 98 may be moved with the movable deck 23.

The positive displacement pump 100, such as the pump illustrated in FIG. 6, and the reservoir thereon may be pivotally mounted to the carriage 95, with the glue tube 91 extending therefrom. A pair of arms 101 and 102 are pivoted at a joint 103 to the carriage, with a glue tube section 104 extending between the end of these arms. A rotary joint 105 is provided between the glue tube 104 and the end of the glue tube 91 and the other end 106 of the glue tube 104 is free and extends downwardly to direct glue to the cover. (It is to be noted that FIG. 7 is a top view of the assembly.)

Figure 8:
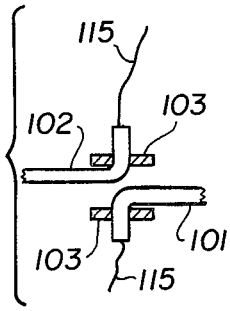
FIG. 8 is a simplified illustration of the mounting of the conductor heating assembly of the arrangement of FIG. 7.

The arms 101 and 102 and the glue tube 104 thereby form a triangular assembly. This assembly is moved toward the stop 96 by means of a solenoid 108, whereby the solenoid, when energized, urges the arm 101 against the stop 96. A spring 109 is coupled to the triangular assembly to move this assembly in the opposite direction, i.e., to move the arm 101 against the stop 98. The solenoid 108 is periodically energized. For example, a switch 110 may be mounted on the carriage to engage sequentially contact segments 111 on the end of the roll 65, so that as the roll 65 rotates, the solenoid is periodically pulsed. When the solenoid is thus energized, the triangular assembly is moved toward the stop plate 96, so that the end of the glue tube 104 is positioned at one side of the region of the cover to which adhesive is to be applied. Upon release of the solenoid, the spring 109 urges the triangular assembly in the opposite direction against the stop 98, to thereby position the end of the glue tube 104 at the other side of the area to be glued. Due to the back and forth movement of the triangular assembly 101, 102, 104, the glue tube 91 is moved back and forth, to effect the pumping action as described above with reference to FIG. 6. Consequently, strips of glue will be applied transversely of the region of the cover to be glued, as the roll 65 is moved from one edge of the cover to the other. The triangular assembly may also serve as means for heating the glue tube 104. For this purpose, as illustrated in FIG. 8, the arms 101 and 102 may comprise electrical conductors separately pivoted at the joint 103, and adapted to be connected to suitable supply leads 115. The other ends of these arms are connected electrically to the tube 104, whereby current passing through the tube 104 heats the tube, and the glue therein.

Figure 9:
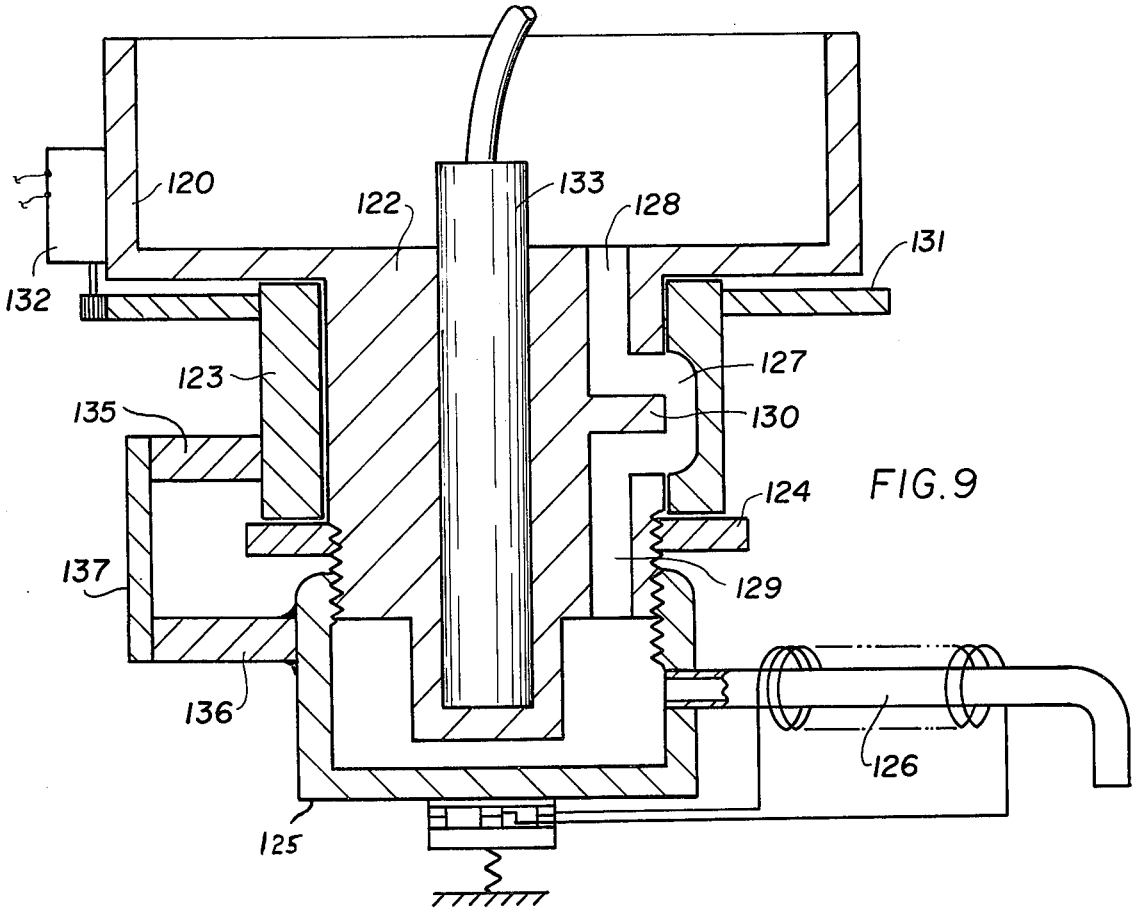
FIG. 9 is a cross sectional view of a further positive displacement pump which may be employed in the apparatus of FIG. 1.
Figure 10:
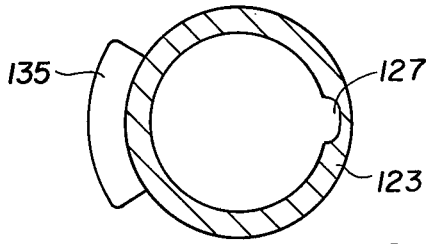
FIG. 10 is a top view of the sleeve of the pump of FIG. 9.

In a further form of a positive displacement in accordance with the invention, as illustrated in FIG. 9, the reservoir 120 is provided with a downwardly extending cylindrical portion 122, and a sleeve 123 is rotatably mounted on the projection 122. The sleeve is held in position by means of a nut 124 threaded to the bottom of the projection 122. A cup 125 is also threaded onto the bottom of the projection 122. A glue tube 126 extends from the cup 125. The sleeve 123 has, on one side of its interior surface, a recess 127. A hole 128 extends downwardly from the bottom wall of the reservoir 120, and a hole 129 aligned with the hole 128 extends upwardly from the cup 125. These holes are separated by a barrier 130, with the holes 128 and 129 extending through the wall of the projection 122 at the barrier 130. A gear 131 is affixed to continuously rotate the sleeve 123, for example, by means of a motor 132 which may be affixed to the wall of the reservoir. As a consequence, upon rotation of the sleeve 123, the recess 127 periodically opens a channel between the reservoir 120 and the cup 125. A suitable heating element 133 may be provided in the reservoir 120, for example, being mounted in the projection 122.

As illustrated in FIG. 9, a cam 135 is provided on the outer surface of the sleeve 123. A projection 136 extends outwardly from the cup 125, and a plate spring 137 is mounted on the projection 136. The spring 137 is mounted to engage the outer surface of the cam 135. As a consequence, when the cam 135 engages the spring 137, it rotates the cup 125. After the glue tube strikes the stop 98, the spring 137 will be forced from engagement with the cam, so that the glue tube will be returned to the stop 96 by means of spring 96. Since the cup 125 is threaded onto the projection 122, the rotation of the cup effects a change in volume in the cup, i.e., between the interior of the cup and the bottom of the projection 122. At the time that the cup 125 is thus moving upwardly, the channel between the reservoir and the cup is closed by the sleeve 123, and hence glue is forced out of the glue tube 126. The glue tube 126 is adapted to be returned by means of a spring 142, so that the volume in the cup 125 increases, thereby enabling the glue to be drawn from the reservoir 120 into the cup 125 when the recess 127 of the sleeve is aligned with the holes 128 and 129.

Figure 11:
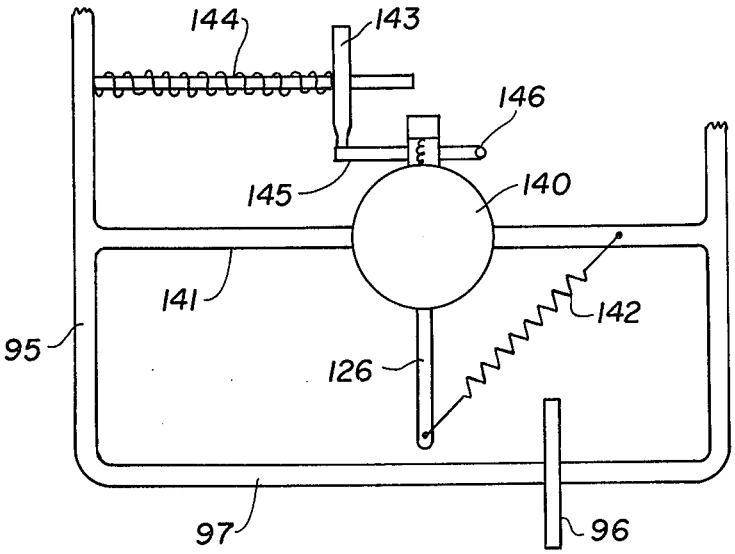
FIG. 11 is a simplified top view of a glue dispensing apparatus of the type illustrated in FIG. 9, employed on the apparatus of FIG. 1.

An alternate arrangement is more clearly shown in FIG. 11, wherein the pump, identified by the numeral 140 is mounted to an arm 141 of the carriage 95. The glue tube 126 is biased toward the fixed stop 96 by means of a spring 142. In this modification, the adjustable stop 143 is mounted on a further arm 144 at the opposite side of the carriage 95, the stop 143 carrying an arm 145 which extends under the projection 136 and has an upward projection 146. In this arrangement, the plate spring 137 is a lever pivotally mounted to the cam 136, and extends below the projection 136. As the sleeve 123 rotates, it catches the element 137, and rotates the glue tube 126 in a clockwise direction as shown in FIG. 11. When the element 137 is moved to the position of the projection 146, it is caught by the projection 146, whereby the element 137 is forced out of contact with the cam 135. This effects the release of the cup 125, whereby the glue tube is resiliently urged by means of the spring 142 against the stop 96. As a consequence, the glue tube 126 is moved back and forth across the region of the cover 76 to which adhesive is to be applied.

It will of course be apparent that the apparatus in accordance with the invention may be automatically controlled by suitable sequential action of the various controls, i.e., the solenoid 39, and the motors 54, 57, 60 and 72. For example, a conventional cam operated timer may be employed for this purpose.

While the invention has been disclosed with reference to a single embodiment, it will be apparent that variations and modifications may be made therein, and it is therefore intended in the following claims to cover each such variation and modification as falls within the true spirit and scope of the invention.

What is claimed is:

1. A book binding apparatus comprising means for determining the thickness of a book to be bound comprising clamping means for holding said book, means for grooving a cover to be bound to said book comprising a pair of parallel groove bars mounted to engage one side of said cover and a backup roll mounted to engage the other side of said cover, and means responsive to said thickness determining means for spacing said groove bars apart a distance dependent upon the thickness of said book, and a glue-applying means mounted for movement with said roll, said glue-applying means comprising glue tube movable across said cover transversely of the direction of movement of said roll, means responsive to said thickness determining means for limiting the transverse movement of said glue tube, and positive displacement pump means for directing glue through said glue tube.

2. The apparatus of claim 1 wherein said clamp means comprises a pair of parallel spaced apart book holding plates for clamping therebetween a book to be bound, and means for moving one of said book binding plates with respect to the other, and further comprising a retractable plate between said book holding plates and said means for grooving, said plate being in a plane perpendicular to the planes of said book holding plates and spaced therefrom for supporting the back of said book.

3. The book binding apparatus of claim 1 further comprising a support plate means parallel to said retractable plate for supporting a cover to be bound to said book, said support plate means comprising a fixed support plate and a support plate movable with said one book holding plate, whereby said fixed support plate and movable support plate have facing edges spaced apart a distance that is a function of the thickness of said book, said groove bars being retractably mounted to separate said facing edges.

4. The apparatus of claim 3 comprising groove bar support means for holding said groove bars between said facing edges to engage the bottom of a cover on said support plate means, and means for lowering said groove bar support means to remove said groove bars from contact with said cover.

5. The apparatus of claim 1 wherein said means responsive to said thickness determining means for limiting the transverse movement of said glue tube comprising first and second stop means spaced apart a distance corresponding to the thickness of said book, means for resiliently urging said glue tube toward said first stop means, and means for driving said glue tube toward said second stop means.

6. The apparatus of claim 5 wherein said pump means comprises a cylinder, valve means for directing glue to said cylinder, a piston in said cylinder, and a tube connected to drive said piston and receive glue from said cylinder, said last mentioned tube being connected to said glue tube, and further comprising solenoid means, contact means on said roll for periodically energizing said solenoid, said solenoid being connected to drive said glue tube to said second stop means and to drive said glue tube connected to said piston.

7. The apparatus of claim 5 wherein said positive displacement pump comprises a cylindrical body, a sleeve continuously rotatably mounted on said body and having an internal recess, port means extending between opposite ends of said body and terminating in the cylindrical surface thereof, whereby said port means are interconnected by said recess at determined angular positions of said sleeve, a cup threaded on one end of said body and defining a chamber at said end of said body, means connecting said glue tube to said body, cam means on said sleeve for driving said cup with said sleeve toward said second stop, and spring means for urging said glue tube toward said first stop means.

8. A positive displacement pump comprising a cylindrical body member, a close fitting sleeve rotatably mounted on said body member and co-axial therewith, a recess on the inner surface of said sleeve, first and second port means extending from opposite ends of said body and terminating in the cylindrical surface thereof whereby said port means are interconnected by said recess at determined angular displacements of said sleeve, one end of said body being threaded, a cup threaded on said one end of said body and defining chamber at said one end of said body communicating with said second port means, cam means on said sleeve for contacting said cup through a determined angular displacement in one direction, means rotating said cup said determined angular displacement in the opposite direction, and outlet means for said pump connected to said cup.

9. A method for binding a cover to a book comprising holding a book between a pair of clamping plates, spacing a pair of groove bars apart a distance corresponding to the distance between said plates, placing a cover on said groove bars, rolling a backup roll across the top of said cover, whereby grooves are formed in said cover, moving a glue tube with said roll to deposit glue on said cover, reciprocating said glue tube across said cover transversely of the movement of said roll, and limiting the transverse movement of said glue tube in response to the distance between said plates holding said book, and then releasing said plates and moving said book downwardly to engage the area of said cover to which adhesive has been applied.

* * * * *

UNITED STATES PATENT OFFICE

CERTIFICATE OF CORRECTION

Patent No. 4,075,726 Dated February 28, 1978

Inventor(s) Jens Korsgaard

It is certified that error appears in the above-identified patent and that said Letters Patent are hereby corrected as shown below:

Column 8, line 20: After "defining" insert --a--.

Signed and Sealed this

Tenth Day of October 1978

[SEAL]

Attest:

RUTH C. MASON
*Attesting Officer*

DONALD W. BANNER
*Commissioner of Patents and Trademarks*